US011739941B2

(12) United States Patent
Neal

(10) Patent No.: US 11,739,941 B2
(45) Date of Patent: Aug. 29, 2023

(54) COOKING APPLIANCE WITH MULTI-BURNER GAS OVEN CONTROL

(71) Applicant: Midea Group Co., Ltd., Foshan (CN)

(72) Inventor: Vern A. Neal, Louisville, KY (US)

(73) Assignee: MIDEA GROUP CO., LTD., Guangdong (CN)

( * ) Notice: Subject to any disclaimer, the term of this patent is extended or adjusted under 35 U.S.C. 154(b) by 148 days.

(21) Appl. No.: 17/331,935

(22) Filed: May 27, 2021

(65) Prior Publication Data

US 2022/0381436 A1 Dec. 1, 2022

(51) Int. Cl.
*F24C 3/12* (2006.01)
*F23D 14/06* (2006.01)

(52) U.S. Cl.
CPC ..... *F24C 3/128* (2013.01); *F23D 14/06* (2013.01); *F23D 2207/00* (2013.01); *F23D 2208/10* (2013.01)

(58) Field of Classification Search
CPC .. F23D 14/06; F23D 2207/00; F23D 2208/10; F24C 3/128
USPC ..... 126/39 E
See application file for complete search history.

(56) References Cited

U.S. PATENT DOCUMENTS 3,149,624 A * 9/1964 Reeves ..... A47B 47/05 126/190
3,194,227 A 7/1965 Beach et al.
3,386,656 A 6/1968 Bergquist
3,469,567 A * 9/1969 Bergquist ..... F24C 3/128 126/39 R
3,551,083 A 12/1970 Michaels
3,622,257 A 11/1971 Hein et al.
4,519,771 A 5/1985 Six et al.
5,033,449 A 7/1991 Hanagan
5,425,631 A * 6/1995 Krueger ..... F24C 3/126 431/71
10,151,493 B2 * 12/2018 French ..... F24C 3/103
10,830,449 B2 11/2020 French et al.
2020/0333013 A1 10/2020 Querejeta Andueza et al.

OTHER PUBLICATIONS

Heartland Appliances Inc., Installation and Operating Instructions Model 9100/7100 Gas Range, Manual #7715 Rev 091906, Heartland Appliances, Inc., 2006.

* cited by examiner

*Primary Examiner* — Vivek K Shirsat
(74) *Attorney, Agent, or Firm* — Gray Ice Higdon

(57) ABSTRACT

A multi-burner gas oven control system is used in a cooking appliance to control multiple gas burners disposed in one or more cooking cavities of the cooking appliance. Each gas burner has an associated dedicated gas valve that is coupled to a gas supply through a common, shared gas valve, as well as an igniter that is used to ignite the gas supplied to the gas burner. During activation of a selected gas burner, all igniters are activated in connection with activating the shared gas valve and the dedicated gas valve for the selected gas burner. In addition, in some instances individual ignition sensors may be used to both confirm ignition of the selected gas burner and detect ignition of any unintended gas burner.

19 Claims, 4 Drawing Sheets

COOKING APPLIANCE WITH MULTI-BURNER GAS OVEN CONTROL

BACKGROUND

Cooking appliances that include ovens, e.g., ranges, wall-mounted ovens, and the like, generally incorporate multiple cooking elements disposed at different locations in an oven cavity. One or more bake cooking elements are generally positioned on the bottom or underneath the bottom of the oven cavity, while one or more broiler cooking elements are generally positioned near the top of the oven cavity (for the purpose of simplification, this description will use the term "cooking element" to refer to any of the various heat sources that may be utilized to generate the heat required for cooking, which may include, but are not limited to, resistive electrical heating elements, gas burners, infrared heaters, quartz heaters, etc.) Some cooking appliances may also include multiple ovens, each having multiple cooking burners within, and as such, some cooking appliances may include a multitude of cooking elements disposed therein.

In cooking appliances that rely on gas burners as oven cooking elements, the gas burners are generally controlled individually, and include individual gas valves and igniters that may be actuated by a control circuit to supply gas to, and ignite, a gas burner. Gas burners used in oven applications are also generally operated at a fixed output level, and are cycled on and off in order to maintain a desired temperature setpoint in an oven.

Individual oven gas burner controls, however, can be costly and complicated, particularly as the number of gas burners increases.

SUMMARY

The herein-described embodiments address these and other problems associated with the art by providing a cooking appliance and method of operation thereof in which a multi-burner gas oven control system is used to control multiple gas burners disposed in one or more cooking cavities of the cooking appliance. Each gas burner has an associated dedicated gas valve that is coupled to a gas supply through a common, shared gas valve, as well as an igniter that is used to ignite the gas supplied to the gas burner. During activation of a selected gas burner, all igniters are activated in connection with activating the shared gas valve and the dedicated gas valve for the selected gas burner. In addition, in some instances individual ignition sensors may be used to both confirm ignition of the selected gas burner and detect ignition of any unintended gas burner.

Therefore, consistent with one aspect of the invention, a cooking appliance may include a housing including one or more oven cavities, a plurality of gas burners configured to generate heat within the one or more oven cavities, a shared gas valve in fluid communication with a gas supply, a plurality of dedicated gas valves, each dedicated gas valve in fluid communication with the shared gas valve and a respective gas burner among the plurality of gas burners, a plurality of igniters, each igniter positioned proximate to a respective gas burner among the plurality of gas burners and configured to ignite gas supplied to the respective gas burner, and a controller coupled to the shared gas valve, the plurality of dedicated gas valves and the plurality of igniters. The controller is configured to activate a selected gas burner among the plurality of gas burners by activating the shared gas valve and the respective dedicated gas valve for the selected gas burner to supply gas from the gas supply to the selected gas burner, and concurrently activating all of the plurality of igniters while gas is supplied to the selected gas burner.

Some embodiments may also include a plurality of ignition sensors, each ignition sensor positioned proximate to a respective gas burner among the plurality of gas burners and configured to detect ignition of the respective gas burner. Also, in some embodiments, the controller is configured to confirm activation of the selected gas burner in response to detecting ignition of the selected gas burner with the respective ignition sensor for the selected gas burner during activation of the selected gas burner.

Further, in some embodiments, the controller is configured to deactivate all of the plurality of igniters in response to confirming activation of the selected gas burner. In some embodiments, the controller is configured to deactivate all of the plurality of igniters and the respective dedicated gas valve for the selected gas burner in response to a failure to detect ignition of the selected gas burner with the respective ignition sensor for the selected gas burner during activation of the selected gas burner. In addition, in some embodiments, the controller is further configured to deactivate the shared gas valve in response to the failure to detect ignition of the selected gas burner with the respective ignition sensor for the selected gas burner during activation of the selected gas burner.

In some embodiments, the controller is further configured to generate a user notification indicating the failure to detect ignition in response to the failure to detect ignition of the selected gas burner with the respective ignition sensor for the selected gas burner during activation of the selected gas burner. In addition, in some embodiments, the controller is configured to identify the selected gas burner in the user notification.

Moreover, in some embodiments, the controller is further configured to poll all of the plurality of ignition sensors during activation of the selected gas burner, and in response thereto detect activation of an unintended gas burner in response to detecting ignition of a different gas burner than the selected gas burner with the respective ignition sensor for the different gas burner, and deactivate the shared gas valve and all of the plurality of igniters in response to detecting activation of the unintended gas burner. In some embodiments, the controller is further configured to deactivate all of the plurality of dedicated gas valves in response to detecting activation of the unintended gas burner.

Moreover, in some embodiments, the controller is further configured to generate a user notification indicating activation of the unintended gas burner. In some embodiments, the controller is configured to identify the unintended gas burner in the user notification.

In addition, in some embodiments, each of the plurality of igniters is a spark igniter. In some embodiments, each of the plurality of igniters is a hot surface igniter. Moreover, in some embodiments, each of the plurality of ignition sensors is a flame detector.

Also, in some embodiments, the one or more oven cavities includes a first oven cavity, and the plurality of gas burners includes a bake gas burner disposed proximate a bottom of the first oven cavity and a broil gas burner disposed proximate a top of the first oven cavity. In some embodiments, the one or more oven cavities includes first and second oven cavities, and the plurality of gas burners includes a first gas burner disposed in the first oven cavity and a second gas burner disposed in the second oven cavity. In addition, in some embodiments, the second gas burner is a bake gas burner disposed proximate a bottom of the second oven cavity, and the plurality of gas burners further includes a third, broil gas burner disposed proximate a top of the second oven cavity.

Also, in some embodiments, the controller is configured to activate the selected gas burner during a cooking cycle, the selected gas burner is a first gas burner, and the controller is further configured to activate a second gas burner among the plurality of gas burners during the cooking cycle by activating the shared gas valve and the respective dedicated gas valve for the second gas burner to supply gas from the gas supply to the second gas burner, and concurrently activating all of the plurality of igniters while gas is supplied to the second gas burner.

These and other advantages and features, which characterize the invention, are set forth in the claims annexed hereto and forming a further part hereof. However, for a better understanding of the invention, and of the advantages and objectives attained through its use, reference should be made to the Drawings, and to the accompanying descriptive matter, in which there is described example embodiments of the invention. This summary is merely provided to introduce a selection of concepts that are further described below in the detailed description, and is not intended to identify key or essential features of the claimed subject matter, nor is it intended to be used as an aid in limiting the scope of the claimed subject matter.

DETAILED DESCRIPTION

Figure 1:
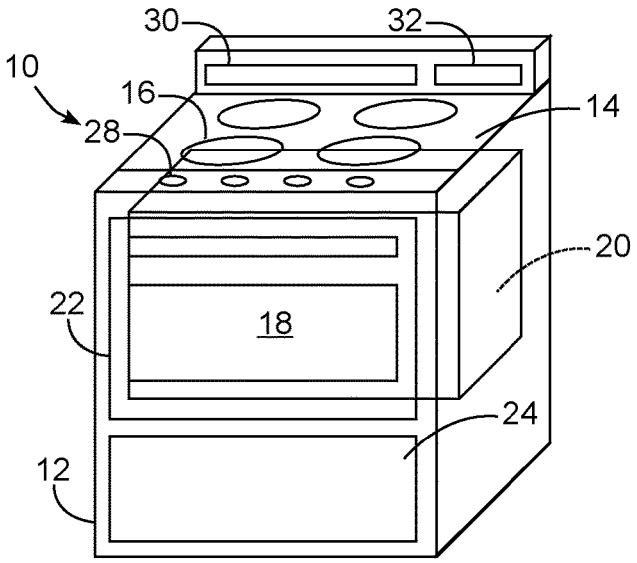
FIG. 1 is a perspective view of a cooking appliance consistent with some embodiments of the invention.

Turning now to the drawings, wherein like numbers denote like parts throughout the several views, FIG. 1 illustrates an example cooking appliance 10 in which the various technologies and techniques described herein may be implemented. Cooking appliance 10 is a residential-type range, and as such includes a housing 12, a stovetop or cooktop 14 including a plurality of burners 16, and an oven 18 defining an oven or cooking cavity 20 accessed via an oven door 22. Cooking appliance 10 may also include a storage drawer 24 in some embodiments, or in other embodiments, may include a second oven. Various cooking elements (not shown in FIG. 1) may also be incorporated into cooking appliance 10 for cooking food in oven 18, e.g., one or more electric or gas cooking elements.

Cooking appliance 10 may also include various user interface devices, including, for example, control knobs 28 for controlling burners 16, a control panel 30 for controlling oven 18 and/or burners 16, and a display 32 for providing visual feedback as to the activation state of the cooking appliance. It will be appreciated that cooking appliance 10 may include various types of user controls in other embodiments, including various combinations of switches, buttons, knobs and/or sliders, typically disposed at the rear or front (or both) of the cooking appliance. Further, in some embodiments, one or more touch screens may be employed for interaction with a user. As such, in some embodiments, display 32 may be touch sensitive to receive user input in addition to displaying status information and/or otherwise interacting with a user. In still other embodiments, cooking appliance 10 may be controllable remotely, e.g., via a smartphone, tablet, personal digital assistant or other networked computing device, e.g., using a web interface or a dedicated app.

Display 32 may also vary in different embodiments, and may include individual indicators, segmented alphanumeric displays, and/or dot matrix displays, and may be based on various types of display technologies, including LEDs, vacuum fluorescent displays, incandescent lights, etc. Further, in some embodiments audio feedback may be provided to a user via one or more speakers, and in some embodiments, user input may be received via a spoken or gesture-based interface.

As noted above, cooking appliance 10 of FIG. 1 is a range, which combines both a stovetop and one or more ovens, and which in some embodiments may be a standalone or drop-in type of range. In other embodiments, however, cooking appliance 10 may be another type of cooking appliance, e.g., a wall mount or freestanding oven. In general, a cooking appliance consistent with the invention may be considered to include any residential-type appliance including a housing and one or more cooking elements disposed therein and configured to generate energy for cooking food within one or more oven cavities.

In turn, a cooking element may be considered to include practically any type of energy-producing element used in residential applications in connection with cooking food, e.g., employing various cooking technologies such as electric, gas, light, microwaves, induction, convection, radiation, etc. In the case of an oven, for example, one or more cooking elements therein may be gas, electric, light, or microwave cooking elements in some embodiments, while in the case of a stovetop, one or more cooking elements therein may be gas, electric, or inductive cooking elements in some embodiments. Further, it will be appreciated that any number of cooking elements may be provided in a cooking appliance (including multiple cooking elements for performing different types of cooking cycles such as baking or broiling, including multiple bake and/or multiple broiler cooking elements, as well as one or more convection cooking elements), and that multiple types of cooking elements may be combined in some embodiments, e.g., combinations of microwave and light cooking elements in some oven embodiments.

Figure 2:
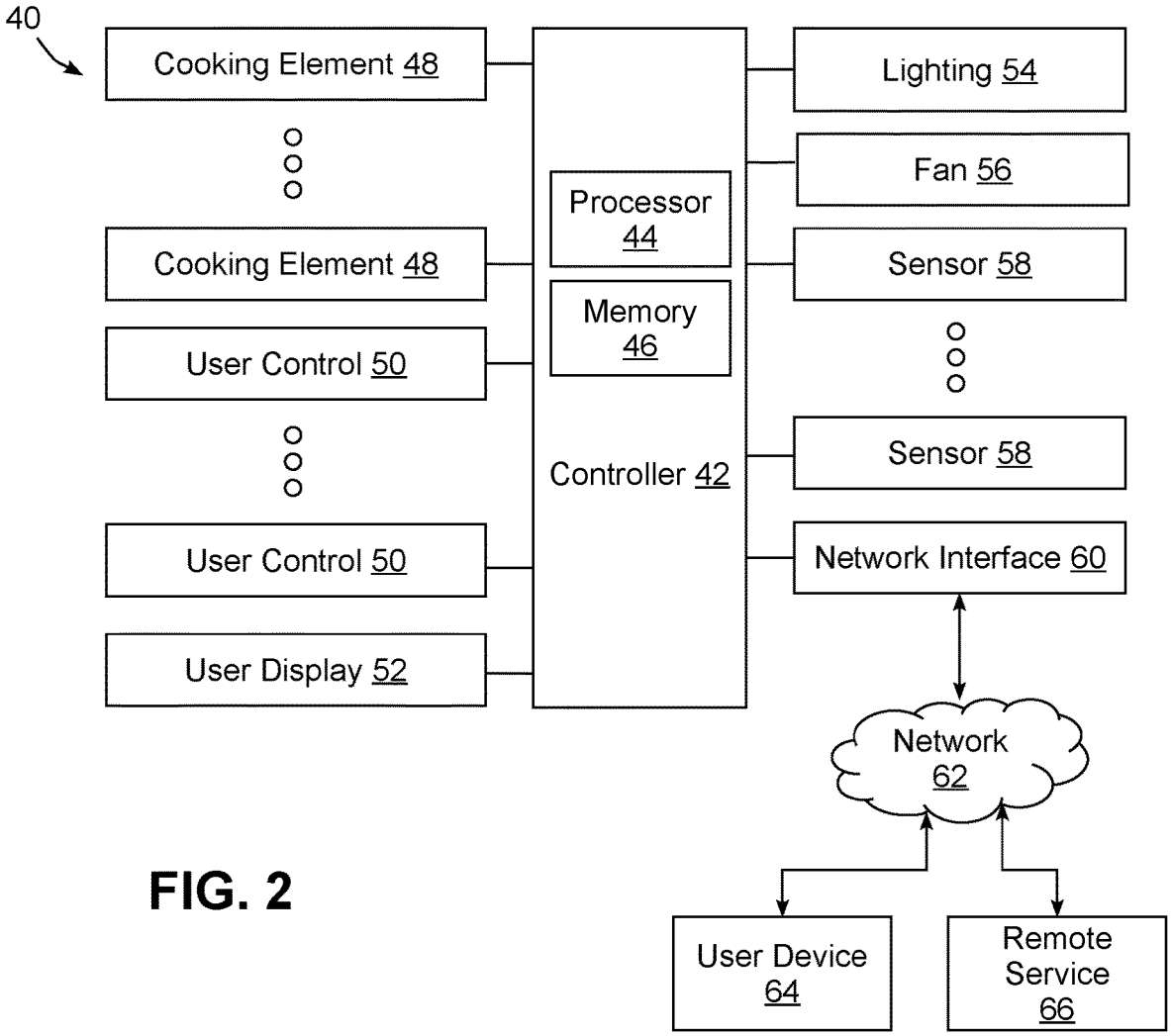
FIG. 2 is a block diagram of an example control system for a cooking appliance consistent with some embodiments of the invention.

A cooking appliance consistent with the invention also generally includes one or more controllers configured to control the cooking elements and otherwise perform cooking operations at the direction of a user. FIG. 2, for example, illustrates an example embodiment of a cooking appliance 40 including a controller 42 that receives inputs from a number of components and drives a number of components in response thereto. Controller 42 may, for example, include one or more processors 44 and a memory 46 within which may be stored program code for execution by the one or more processors. The memory may be embedded in controller 42, but may also be considered to include volatile and/or non-volatile memories, cache memories, flash memories, programmable read-only memories, read-only memories, etc., as well as memory storage physically located elsewhere from controller 42, e.g., in a mass storage device or on a remote computer interfaced with controller 42.

As shown in FIG. 2, controller 42 may be interfaced with various components, including various cooking elements 48 used for cooking food (e.g., various combinations of gas, electric, inductive, light, microwave, light cooking elements, among others), one or more user controls 50 for receiving user input (e.g., various combinations of switches, knobs, buttons, sliders, touchscreens or touch-sensitive displays, microphones or audio input devices, image capture devices, etc.), and a user display 52 (including various indicators, graphical displays, textual displays, speakers, etc.), as well as various additional components suitable for use in a cooking appliance, e.g., lighting 54 and/or one or more fans 56 (e.g., convection fans, cooling fans, etc.), among others.

Controller 42 may also be interfaced with various sensors 58 located to sense environmental conditions inside of and/or external to cooking appliance 40, e.g., one or more temperature sensors, humidity sensors, air quality sensors, smoke sensors, carbon monoxide sensors, odor sensors and/or electronic nose sensors, among others. Such sensors may be internal or external to cooking appliance 40, and may be coupled wirelessly to controller 42 in some embodiments. Sensors 58 may include, for example, one or more temperature sensors for sensing an air temperature within an oven cavity, including, for example, a temperature sensor for sensing temperature in a center of the oven cavity and/or one or more temperature sensors for sensing temperature in the top and/or bottom of the oven cavity.

In some embodiments, controller 42 may also be coupled to one or more network interfaces 60, e.g., for interfacing with external devices via wired and/or wireless networks such as Ethernet, Wi-Fi, Bluetooth, NFC, cellular and other suitable networks, collectively represented in FIG. 2 at 62. Network 62 may incorporate in some embodiments a home automation network, and various communication protocols may be supported, including various types of home automation communication protocols. In other embodiments, other wireless protocols, e.g., Wi-Fi or Bluetooth, may be used. In some embodiments, cooking appliance 40 may be interfaced with one or more user devices 64 over network 62, e.g., computers, tablets, smart phones, wearable devices, etc., and through which cooking appliance 40 may be controlled and/or cooking appliance 40 may provide user feedback. Further, in some embodiments, cooking appliance 40 may be interfaced with one or more remote services 66, e.g., cloud-based services, remote servers.

In some embodiments, controller 42 may operate under the control of an operating system and may execute or otherwise rely upon various computer software applications, components, programs, objects, modules, data structures, etc. In addition, controller 42 may also incorporate hardware logic to implement some or all of the functionality disclosed herein. Further, in some embodiments, the sequences of operations performed by controller 42 to implement the embodiments disclosed herein may be implemented using program code including one or more instructions that are resident at various times in various memory and storage devices, and that, when read and executed by one or more hardware-based processors, perform the operations embodying desired functionality. Moreover, in some embodiments, such program code may be distributed as a program product in a variety of forms, and that the invention applies equally regardless of the particular type of computer readable media used to actually carry out the distribution, including, for example, non-transitory computer readable storage media. In addition, it will be appreciated that the various operations described herein may be combined, split, reordered, reversed, varied, omitted, parallelized and/or supplemented with other techniques known in the art, and therefore, the invention is not limited to the particular sequences of operations described herein.

Numerous variations and modifications to the cooking appliances illustrated in FIGS. 1-2 will be apparent to one of ordinary skill in the art, as will become apparent from the description below. Therefore, the invention is not limited to the specific implementations discussed herein.

Multi-Burner Gas Oven Control System

The ovens used in residential cooking appliances commonly include multiple cooking elements, including one or more bake cooking elements disposed near the bottom of an oven cavity, one or more broil cooking elements disposed near the top of an oven cavity, and in some instances one or more convection cooking elements used with a fan that circulates hot air in a convection cycle. Some cooking appliances also include multiple ovens, so it would not be uncommon for a cooking appliance to include four or more cooking elements.

For gas ovens, where the cooking elements are gas burners supplied by a gas supply, conventionally each gas burner is controlled individually, with its own igniter and gas valve controlling gas flow, as the technology is both common and low cost. However, as the number of gas burners in a cooking appliance increases, it becomes increasingly cost prohibitive to control each gas burner individually.

In the illustrated embodiments, however, a multi-burner gas oven control system is used to combine the control of multiple gas burners to a single or common control circuit or controller. In a multi-burner gas oven control system consistent with the invention, a central gas control mechanism is used, including a set of shared and dedicated gas valves. A common or shared gas valve allows/prevents gas flow to the dedicated gas valves, and each dedicated gas valve is dedicated to a single gas burner. Thus, in order for gas flow to reach an individual gas burner, both the shared gas valve and that burner's individual dedicated gas valve must be activated.

In addition, in the illustrated embodiment, each gas burner is equipped with its own igniter, and in some embodiments, with its own ignition sensor (e.g., a flame detector), and when any selected gas burner is ignited, the igniters for all gas burners are concurrently activated while gas is supplied to the selected gas burner via the activation of both the shared gas valve and the dedicated gas valve for the selected gas burner.

By concurrently activating all igniters, in the event of a gas valve failure or miswiring of the control system (e.g., wiring the igniter, ignition sensor and/or dedicated gas valve for one gas burner to the control inputs for a different gas burner), ignition of gas unintentionally output by any gas burner will be ignited, rather than building up in the oven cavity. Moreover, where an ignition sensor is used, the ignition sensor may be used to detect the ignition of an unintended gas burner and enable the control system to shut down the oven and/or alert a user of the potential error.

In addition, in some embodiments, a control system may include software and/or hardware to interlock one or more gas burners, such that certain gas burners are not allowed to be operated simultaneously.

Figure 3:
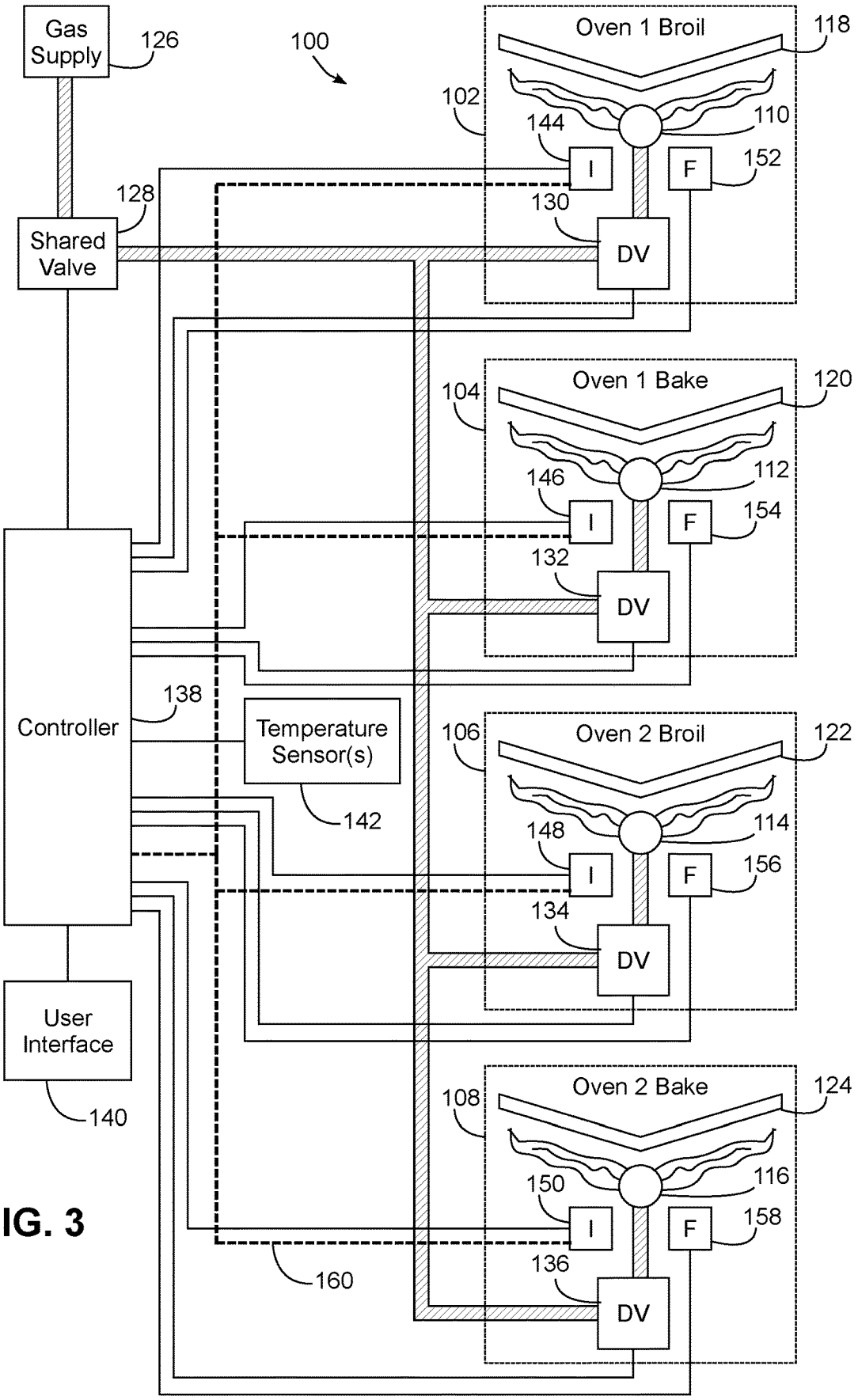
FIG. 3 is a block diagram of an example multi-burner gas oven control system consistent with some embodiments of the invention.

FIG. 3 illustrates an example cooking appliance 100, e.g., a range or wall oven, including a multi-burner gas oven control system consistent with the invention. Cooking appliance 100 includes two oven cavities or ovens, each with bake and broil functionality, represented at 102 (oven 1 broil), 104 (oven 1 bake), 106 (oven 2 broil) and 108 (oven 2 bake). Each includes a respective gas burner 110, 112, 114, 116 and associated flame spreader 118, 120, 122, 124. Gas is supplied to the control system from a gas supply 126 that may be internal or external to the appliance, with a shared gas valve 128 outputting to a set of dedicated gas valves 130, 132, 134, 136 that are dedicated to each of gas burners 110, 112, 114, 116, such that when the shared gas valve 128 is activated along with one of the dedicated gas valves 130, 132, 134, 136, the respective gas burner 110, 112, 114, 116 is in fluid communication with gas supply 126. The gas lines representing the gas flow paths from gas supply 126 to gas burners 110, 112, 114, 116 are shown in cross-hatching.

A controller 138, e.g., a microprocessor, a microcontroller, a control circuit, etc. (including any supporting hardware circuitry), is electrically coupled to each gas valve 128-136 to selectively activate each gas valve 128-136. In the illustrated embodiment, each gas valve 128-136 is an on/off valve, such that each gas burner has a fixed output power or level. In other embodiments, any of gas valves 128-136 may be variable gas valves, or additional variable gas valves may be included in the gas flow paths, in order to regulate the output level of one or more of the gas burners.

Controller 138 may also be coupled to a user interface 140, e.g., a display, one or more indicators, a touch screen, a set of physical controls such as buttons, switches, knobs, etc., a remote device such as a mobile device, or any other suitable technology for receiving user input and/or displaying data to a user. Through user interface 140, for example, a user may select a cooking temperature or output level, a cycle type (e.g., bake, broil, convection bake, convection roast, etc.), a cycle time, a delay time, or any other settings that may be appropriate for a desired oven cooking cycle. In addition, one or more temperature sensors 142 may be disposed in each oven cavity to sense current temperature in the oven cavity.

Each gas burner 110, 112, 114, 116 also includes a respective igniter 144, 146, 148, 150 and a respective ignition sensor 152, 154, 156, 168. Each igniter 144, 146, 148, 150 may be a direct igniter such as a spark igniter in some embodiments, while in other embodiments, a proven igniter such as a hot surface igniter may be used, whereby each igniter remains active the entire time gas is flowing. Each ignition sensor 152, 154, 156, 158 may be implemented using a flame detector or another suitable technology for sensing ignition of a gas burner, or may be omitted in some embodiments. In addition, while controller 138 is illustrated as having separate control outputs routed to the individual igniters 144, 146, 148, 150 to support individual control thereof, in other embodiments, and as illustrated by dashed line 160, the igniters 144, 146, 148, 150 may be controlled by the same control output, e.g., generated by controller 138 or a separate ignition module. In addition, it will be appreciated that in some embodiments, an igniter and an ignition sensor may be integrated into the same component that performs both functions.

Figure 4:
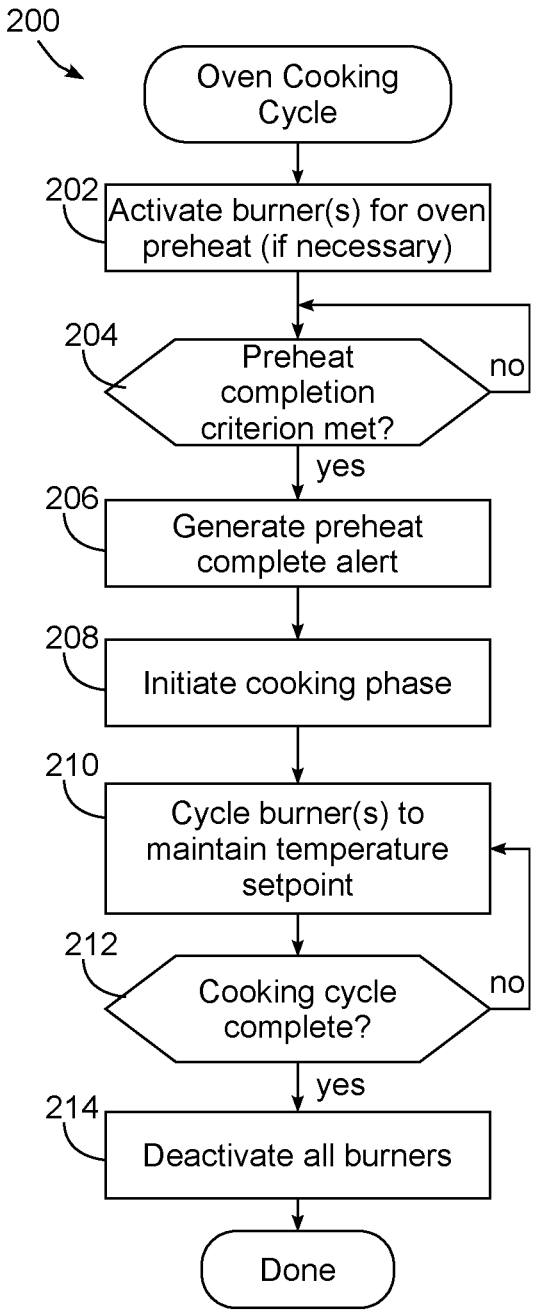
FIG. 4 is a flowchart illustrating an example sequence of operations for performing a cooking cycle using the multi-burner gas oven control system of FIG. 3.

FIG. 4 next illustrates an example sequence of operations 200 for performing an oven cooking cycle, for example, using controller 138 of FIG. 3 and in response to user input selecting various settings for the oven cooking cycle and requesting that the oven cooking cycle be started. Assuming, for the purposes of this example, that the selected oven cooking cycle has a desired temperature setpoint and thus requires a preheat phase to enable the oven to reach that desired temperature setpoint, block 202 activates the appropriate gas burner(s) in the appropriate oven to initiate the preheat phase. Block 204 waits until a preheat completion criterion has been met (e.g., the oven cavity temperature reaching the desired temperature setpoint), and once the criterion is met, control passes to block 206 to generate a preheat complete alert, e.g., a audible beep, a message on a display, a message on a mobile device, etc. Next, in block 208 the cooking phase is initiated, and in block 210, one or more of the gas burners is cycled (i.e., selectively activated and/or deactivated) to maintain the desired temperature setpoint in the oven cavity. While the cooking cycle is ongoing, block 212 returns control to block 210 to continuing the cycling of the gas burner(s), but once the cooking cycle is complete, e.g., as a result of a completion time being met, or as a result of a user turning off the oven, control passes to block 214 to deactivate all gas burners used in the cooking cycle, and the cooking cycle is complete. Deactivating all gas burners, in this regard, may include deactivating or shutting off the dedicated gas valve(s) for the gas burner(s) used in the cooking cycle, deactivating or shutting off any igniters for the gas burner(s) used in the cooking cycle (e.g., if proven igniters are used), and if no other cooking cycles are still active, deactivating or shutting off the shared gas valve.

Figure 5:
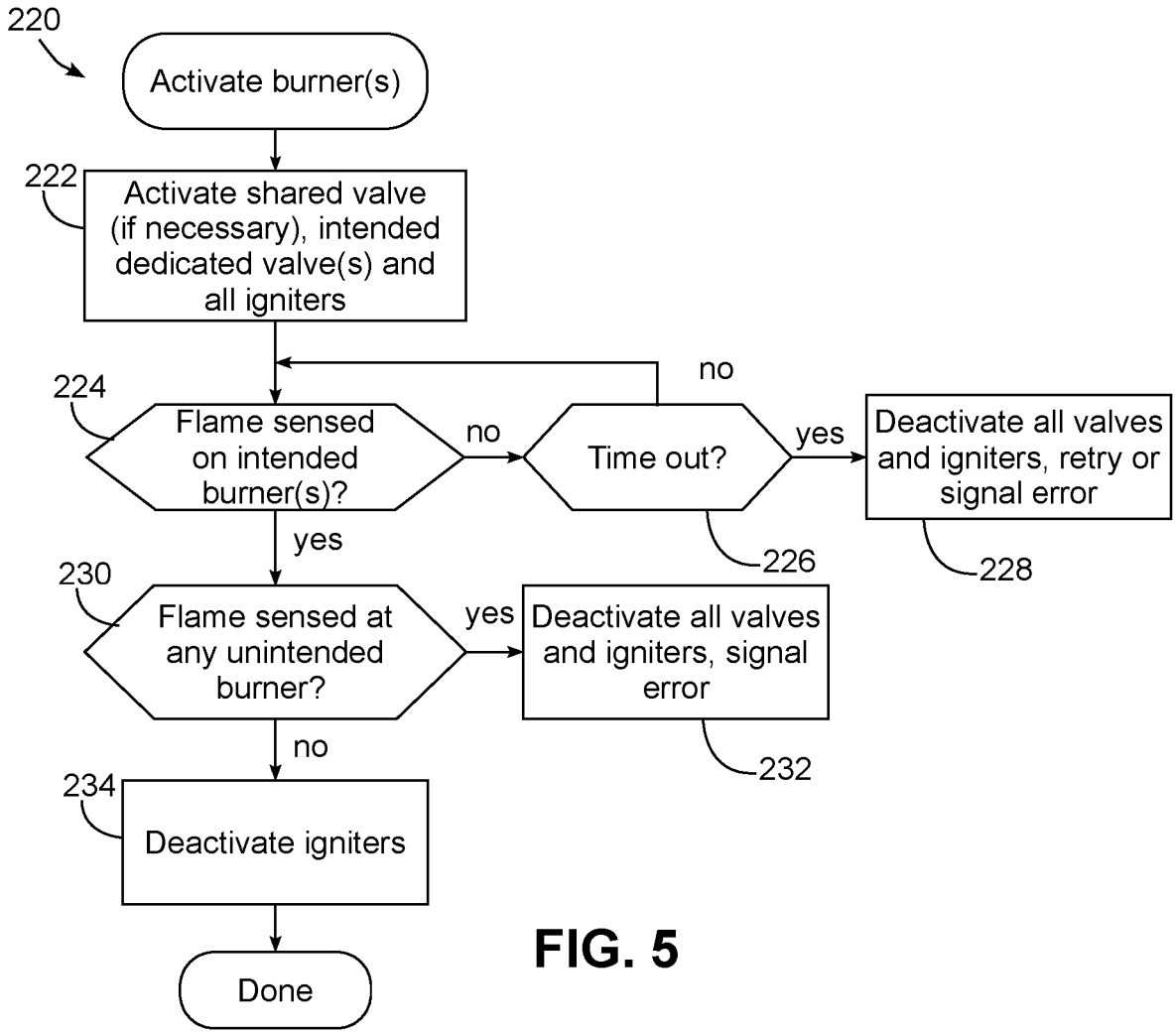
FIG. 5 is a flowchart illustrating an example sequence of operations for activating a gas burner in the sequence of operations of FIG. 4.

FIG. 5 next illustrates an example sequence of operations 220 for activating one or more gas burners, e.g., during block 202 (preheat phase) or block 210 (cooking phase) of FIG. 4. For the purposes of this example, each gas burner desired to be activated may be referred to as an intended or selected gas burner, while a gas burner for which no activation is desired or expected may be referred to as an unintended gas burner. Also for the purposes of this example, it is assumed that the igniters are direct igniters, and ignition sensors are also used.

First, in block 222, the shared gas valve is activated if necessary (e.g., if no other gas burners are currently active) along with the dedicated valve(s) for all intended gas burners (thereby establishing gas flow to each intended gas burner). In addition, the igniters for all gas burners (both intended and unintended) are activated. It will be appreciated that these operations may occur concurrently in some embodiments, while in other embodiments, different sequences may be used, e.g., to change the order in which the dedicated gas valve(s), shared gas valve and igniter(s) are activated (for example, to start the igniters shortly before establishing gas flow to the gas burner(s).

Block 224 next enters a loop to wait for the intended gas burner(s) to ignite, and polls all of the ignition sensors for the intended gas burners to attempt to confirm that all of the intended gas burners are ignited. If not, control passes to block 226 to determine if a time out has occurred, i.e., based upon a predetermined timer duration from the beginning of the activation effort. If a time out has occurred, then successful ignition has not occurred within the predetermined timer duration, so block 226 passes control to block 228 to deactivate all gas valves and igniters. In the alternative, if, for example, another cooking cycle is in progress in another oven, only a subset of the dedicated gas valves may be deactivated in block 228, thereby allowing the other cooking cycle to continue. Also, at this time, activation may be re-attempted one or more times in some embodiments, with a delay between activation attempts optionally used in some embodiments to allow for uncombusted gas in the oven cavity to disperse.

Further, in addition to or in lieu of performing additional attempts, an error may be signaled in block 228, e.g., by generating a user notification such as an audible alert, a message on a display, a message on a mobile device, etc. In addition, in some embodiments the user notification may include an identification of any gas burners involved in the activation attempt, e.g., "ignition failure detected for oven 1 broil burner, retrying".

Returning to block 224, if successful ignition has been confirmed for all intended gas burners, control passes to block 230 to poll the ignition sensors for all other gas burners to determine if a flame has been sensed at any of these unintended gas burners. Ignition or activation of an unintended gas burner could potentially occur, for example, if the control wires for the dedicated gas valve for the unintended gas burner were miswired or shorted to those of another gas valve, or if the dedicated gas valve for the unintended gas burner was stuck in an open state. Thus, if any unintended gas burner is found to be activated, block 230 passes control to block 232 to deactivate all gas valves (or at least the shared gas valve) and igniters and signal an error. In some instances, the deactivation may be limited to the gas burners in the affected oven cavity, while in other instances, it may be desirable to effectively disable all gas burners until the cooking appliance can be serviced. The signaled error may include, for example, a user notification such as an audible alert, a message on a display, a message on a mobile device, a message to a service organization, etc. In addition, in some embodiments the user notification may include an identification of the unintended gas burner that was activated, e.g., "unexpected ignition detected for oven 1 broil burner, oven has been disabled".

Returning to block 230, if no activated unintended gas burners were detected, control passes to block 234 to deactivate the igniters, whereby all intended gas burners have been successfully activated. Sequence 220 is then complete.

It will be appreciated that various modifications may be made to the embodiments discussed herein, and that a number of the concepts disclosed herein may be used in combination with one another or may be used separately. Therefore, the invention lies in the claims hereinafter appended.

What is claimed is:

1. A cooking appliance, comprising:

a housing including one or more oven cavities;

a plurality of gas burners configured to generate heat within the one or more oven cavities;

a shared gas valve in fluid communication with a gas supply, wherein the shared gas valve is electrically-controllable;

a plurality of dedicated gas valves, each dedicated gas valve in fluid communication with the shared gas valve and a respective gas burner among the plurality of gas burners, wherein each dedicated gas valve is electrically-controllable;

a plurality of igniters, each igniter positioned proximate to a respective gas burner among the plurality of gas burners and configured to ignite gas supplied to the respective gas burner; and a controller electrically coupled to the shared gas valve, the plurality of dedicated gas valves and the plurality of igniters, the controller configured to activate a selected gas burner among the plurality of gas burners by:

concurrently activating the shared gas valve and the respective dedicated gas valve for the selected gas burner to supply gas from the gas supply to the selected gas burner; and concurrently activating all of the plurality of igniters while gas is supplied to the selected gas burner.

2. The cooking appliance of claim 1, further comprising a plurality of ignition sensors, each ignition sensor positioned proximate to a respective gas burner among the plurality of gas burners and configured to detect ignition of the respective gas burner.

3. The cooking appliance of claim 2, wherein the controller is configured to confirm activation of the selected gas burner in response to detecting ignition of the selected gas burner with the respective ignition sensor for the selected gas burner during activation of the selected gas burner.

4. The cooking appliance of claim 3, wherein the controller is configured to deactivate all of the plurality of igniters in response to confirming activation of the selected gas burner.

5. The cooking appliance of claim 2, wherein the controller is configured to deactivate all of the plurality of igniters and the respective dedicated gas valve for the selected gas burner in response to a failure to detect ignition of the selected gas burner with the respective ignition sensor for the selected gas burner during activation of the selected gas burner.

6. A cooking appliance, comprising:

a housing including one or more oven cavities;

a plurality of gas burners configured to generate heat within the one or more oven cavities;

a shared gas valve in fluid communication with a gas supply;

a plurality of dedicated gas valves, each dedicated gas valve in fluid communication with the shared gas valve and a respective gas burner among the plurality of gas burners;

a plurality of igniters, each igniter positioned proximate to a respective gas burner among the plurality of gas burners and configured to ignite gas supplied to the respective gas burner;

a plurality of ignition sensors, each ignition sensor positioned proximate to a respective gas burner among the plurality of gas burners and configured to detect ignition of the respective gas burner; and a controller coupled to the shared gas valve, the plurality of dedicated gas valves and the plurality of igniters, the controller configured to activate a selected gas burner among the plurality of gas burners by:

activating the shared gas valve and the respective dedicated gas valve for the selected gas burner to supply gas from the gas supply to the selected gas burner; and concurrently activating all of the plurality of igniters while gas is supplied to the selected gas burner;

wherein the controller is configured to deactivate all of the plurality of igniters and the respective dedicated gas valve for the selected gas burner in response to a failure to detect ignition of the selected gas burner with the respective ignition sensor for the selected gas burner during activation of the selected gas burner; and wherein the controller is further configured to deactivate the shared gas valve in response to the failure to detect ignition of the selected gas burner with the respective ignition sensor for the selected gas burner during activation of the selected gas burner.

7. The cooking appliance of claim 5, wherein the controller is further configured to generate a user notification indicating the failure to detect ignition in response to the failure to detect ignition of the selected gas burner with the respective ignition sensor for the selected gas burner during activation of the selected gas burner.

8. The cooking appliance of claim 7, wherein the controller is configured to identify the selected gas burner in the user notification.

9. A cooking appliance, comprising:

a housing including one or more oven cavities;

a plurality of gas burners configured to generate heat within the one or more oven cavities;

a shared gas valve in fluid communication with a gas supply;

a plurality of dedicated gas valves, each dedicated gas valve in fluid communication with the shared gas valve and a respective gas burner among the plurality of gas burners;

a plurality of igniters, each igniter positioned proximate to a respective gas burner among the plurality of gas burners and configured to ignite gas supplied to the respective gas burner;

a plurality of ignition sensors, each ignition sensor positioned proximate to a respective gas burner among the plurality of gas burners and configured to detect ignition of the respective gas burner; and a controller coupled to the shared gas valve, the plurality of dedicated gas valves and the plurality of igniters, the controller configured to activate a selected gas burner among the plurality of gas burners by:

activating the shared gas valve and the respective dedicated gas valve for the selected gas burner to supply gas from the gas supply to the selected gas burner; and concurrently activating all of the plurality of igniters while gas is supplied to the selected gas burner;

wherein the controller is further configured to poll all of the plurality of ignition sensors during activation of the selected gas burner, and in response thereto:

detect activation of an unintended gas burner in response to detecting ignition of a different gas burner than the selected gas burner with the respective ignition sensor for the different gas burner; and deactivate the shared gas valve and all of the plurality of igniters in response to detecting activation of the unintended gas burner.

10. The cooking appliance of claim 9, wherein the controller is further configured to deactivate all of the plurality of dedicated gas valves in response to detecting activation of the unintended gas burner.

11. The cooking appliance of claim 9, wherein the controller is further configured to generate a user notification indicating activation of the unintended gas burner.

12. The cooking appliance of claim 11, wherein the controller is configured to identify the unintended gas burner in the user notification.

13. The cooking appliance of claim 1, wherein each of the plurality of igniters is a spark igniter.

14. The cooking appliance of claim 1, wherein each of the plurality of igniters is a hot surface igniter.

15. The cooking appliance of claim 1, further comprising a plurality of flame detectors, each flame detector positioned proximate to a respective gas burner among the plurality of gas burners and configured to detect ignition of the respective gas burner.

16. The cooking appliance of claim 1, wherein the one or more oven cavities includes a first oven cavity, and wherein the plurality of gas burners includes a bake gas burner disposed proximate a bottom of the first oven cavity and a broil gas burner disposed proximate a top of the first oven cavity.

17. The cooking appliance of claim 1, wherein the one or more oven cavities includes first and second oven cavities, and wherein the plurality of gas burners includes a first gas burner disposed in the first oven cavity and a second gas burner disposed in the second oven cavity.

18. The cooking appliance of claim 17, wherein the second gas burner is a bake gas burner disposed proximate a bottom of the second oven cavity, and wherein the plurality of gas burners further includes a third, broil gas burner disposed proximate a top of the second oven cavity.

19. The cooking appliance of claim 1, wherein the controller is configured to activate the selected gas burner during a cooking cycle, wherein the selected gas burner is a first gas burner, and wherein the controller is further configured to activate a second gas burner among the plurality of gas burners during the cooking cycle by:

activating the shared gas valve and the respective dedicated gas valve for the second gas burner to supply gas from the gas supply to the second gas burner; and concurrently activating all of the plurality of igniters while gas is supplied to the second gas burner.

* * * * *